US008413471B2

(12) United States Patent
Han et al.

(10) Patent No.: US 8,413,471 B2
(45) Date of Patent: Apr. 9, 2013

(54) CLOTH TREATING APPARATUS

(75) Inventors: Dong Joo Han, Changwon-si (KR); Chul Jin Choi, Changwon-si (KR); Young Bok Son, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 12/594,155

(22) PCT Filed: Apr. 4, 2008

(86) PCT No.: PCT/KR2008/001907

§ 371 (c)(1),
(2), (4) Date: Jun. 25, 2010

(87) PCT Pub. No.: WO2008/123698

PCT Pub. Date: Oct. 16, 2008

(65) Prior Publication Data

US 2011/0067457 A1 Mar. 24, 2011

(30) Foreign Application Priority Data

Apr. 4, 2007 (KR) ..... 10-2007-0033314

(51) Int. Cl.
*D06F 29/00* (2006.01)

(52) U.S. Cl.
USPC ..... 68/20

(58) Field of Classification Search ..... 68/19.1, 68/19.2, 20; 34/595, 596
See application file for complete search history.

(56) References Cited

U.S. PATENT DOCUMENTS

| | | | | |
|---|---|---|---|---|
| 5,815,961 | A * | 10/1998 | Estes et al. | 38/14 |
| 6,189,346 | B1 * | 2/2001 | Chen et al. | 68/5 R |
| 2005/0275325 | A1 | 12/2005 | Yang | |
| 2006/0150689 | A1 | 7/2006 | Kim et al. | |
| 2006/0156765 | A1 | 7/2006 | Sunshine et al. | |
| 2007/0151120 | A1 * | 7/2007 | Tomasi et al. | 34/601 |

FOREIGN PATENT DOCUMENTS

| | | | |
|---|---|---|---|
| CN | 2137673 | Y | 7/1993 |
| EP | 1 439 258 | A2 | 7/2004 |
| JP | 2-174900 | A | 7/1990 |
| KR | 10-1999-0077696 | A | 10/1999 |
| KR | 10-2003-0090495 | A | 11/2003 |
| KR | 2005115969 | A * | 12/2005 |
| KR | 10-2006-0048351 | A | 5/2006 |

OTHER PUBLICATIONS

Machine Translation of KR 2005115969 A, Lee et al., Dec. 2005.*

* cited by examiner

*Primary Examiner* — Michael Barr
*Assistant Examiner* — David Cormier
(74) *Attorney, Agent, or Firm* — Birch, Stewart, Kolasch & Birch, LLP

(57) ABSTRACT

A cloth treating apparatus is disclose. The cloth treating apparatus comprises an auxiliary treating apparatus which includes a main body washing or drying clothes; a cabinet provided at one side of the main body; and a drawer slidably provided in the cabinet to form an accommodating space, having a hot air supply device provided in the accommodating space.

10 Claims, 5 Drawing Sheets

CLOTH TREATING APPARATUS

TECHNICAL FIELD

The present invention relates to a cloth treating apparatus, and more particularly, to a cloth treating apparatus comprising an auxiliary treating apparatus which is provided in a main body, which performs washing and drying, to enable drying of objects of small quantity to be dried.

BACKGROUND ART

Generally, a cloth treating apparatus means an apparatus that can wash, dry, or both wash and dry clothes, etc. The cloth treating apparatus performs either a washing function or a drying function, or can perform both washing and drying functions. Also, a cloth treating apparatus having a steam supply device has spread recently, wherein the steam supply device performs a refresh function of clothes, etc., such as wrinkles removing, smell removing, and electrostatic removing.

Meanwhile, conventional cloth treating apparatuses are divided into a front loading type and a top loading type depending on a loading direction of clothes. Also, the cloth treating apparatuses are divided into a vertical type and a horizontal type depending on a washing type, wherein the vertical type includes a pulsator or an inner tub which is rotated, and the horizontal type includes a drum which is arranged horizontally and rotated. Examples of the horizontal type cloth treating apparatus include a drum washing machine and a drum dryer.

Recently, such cloth treating apparatuses are on a large-scaled trend to meet user's request. In other words, outer sizes of cloth treating apparatuses for home use are on a large-scaled trend.

In accordance with such a large-scaled trend, a large-scaled apparatus should be driven to dry objects of small quantity. In this case, a problem occurs in that it is disadvantageous in view of energy saving.

In case of a drum type dryer, since a drum is rotated to tumble objects to be dried, a problem occurs in that the drum type dryer is not suitable for drying of footwear, etc. Furthermore, it is general that footwear of small quantity such as a pair of footwear or two pairs of footwear is washed. In this way, when a conventional dryer is used to dry objects of small quantity, since a drum should be driven and a heater and a fan with high capacity should be driven, it is inefficient in view of energy.

In this respect, instead of the conventional large-scaled washing machine, a small-scaled dryer having capacity smaller than that of the large-scaled washing machine is required. However, it is not desirable in view of space use and a fine view that two washing machines are provided for each home even though one of the washing machines has a small scale.

DISCLOSURE OF INVENTION

Technical Problem

Accordingly, the present invention is directed to a cloth treating apparatus which substantially obviates one or more problems due to limitations and disadvantages of the related art.

An object of the present invention is to provide an improved cloth treating apparatus comprising an auxiliary treating apparatus which is provided at a lower or upper part of the cloth treating apparatus to perform drying for objects of small quantity without driving the cloth treating apparatus of large capacity.

Another object of the present invention is to provide an improved cloth treating apparatus comprising an auxiliary treating apparatus which is advantageous for energy saving unlike a conventional dryer of a drum type.

Other object of the present invention is to provide an auxiliary treating apparatus which removes a smell of objects, such as shoes, which require deodorization, and refreshes the objects.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

Technical Solution

To achieve these objects and other advantages and in accordance with the purpose of the invention, as embodied and broadly described herein, a cloth treating apparatus includes a main body washing or drying clothes; and an auxiliary treating apparatus having a accommodating space provided at one side of the main body to receive clothes, and a hot air supply device supplying a hot air into the accommodating space.

The auxiliary treating apparatus includes a cabinet provided at one side of the main body; and a drawer slidably provided in the cabinet to form a accommodating space, having a hot air supply device provided in the accommodating space. In this case, the cabinet is provided at an upper part or a lower part of the main body. Preferably, the cabinet is provided at the lower part of the main body.

Meanwhile, the hot air supply device includes: a housing provided with an inlet provided at one side inside the accommodating space to flow external air thereto and an outlet exhausting the flown air; a ventilating fan provided at a side inside the housing, ventilating the air, which flows through the inlet, through the outlet; and a heater provided at a side inside the housing to heat the flown air. In this case, the housing is formed at a corner inside the drawer.

To regularly supply hot air to the accommodating space, the hot air supply device is formed in such a manner that a front end of the housing has an arc shape, and the outlet is formed along the arc shape of the front end. Also, the outlet is provided with an air guide which guides flow of the air. In this case, the air guide is formed of a plurality of plates spaced apart from one another along the outlet.

Meanwhile, the drawer includes an opening into which the air flows, and an outlet which exhausts out the air inside the drawer. Preferably, the outlet is provided with a filter.

Furthermore, a cover which is selectively opened and closed is further provided at an upper part of the drawer. Moreover, a drying rack is further provided inside the drawer to arrange clothes thereon. In this case, the drying rack is fixed to one side of the drawer and selectively unfolded, or is formed of a shelf which is detachably formed to partition the space inside the drawer up and down. Also, the drying rack is provided with a plurality of through holes.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings.

BEST MODE FOR CARRYING OUT THE INVENTION

Hereinafter, reference will now be made in detail to the preferred embodiments of the present invention, examples of which are illustrated in the accompanying drawings.

Figure 1:
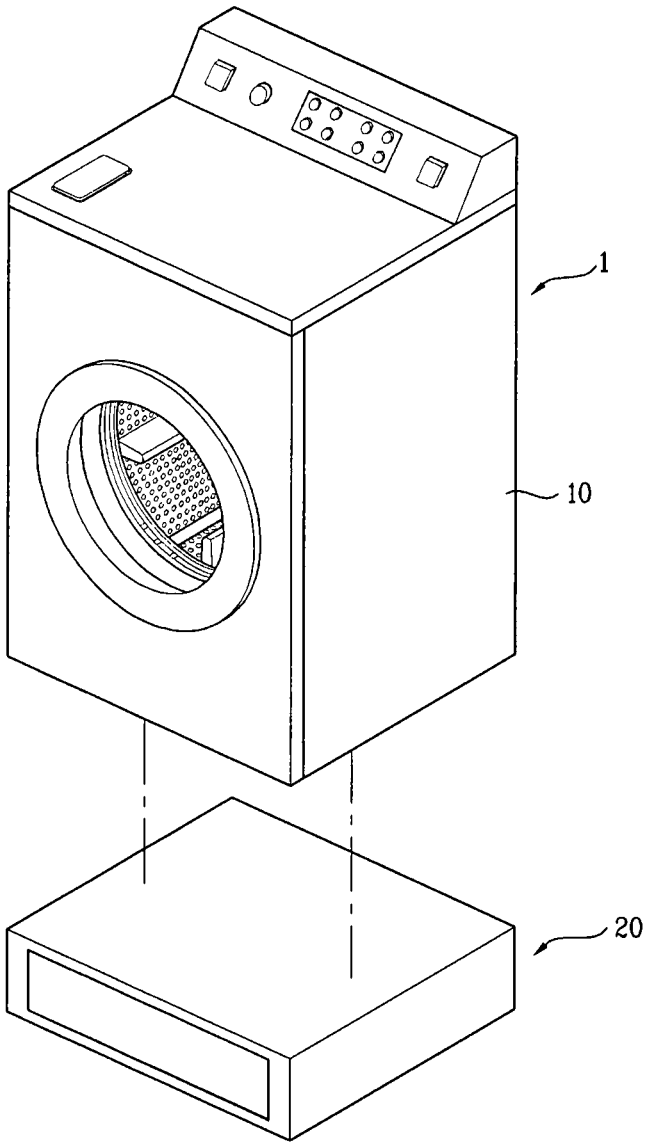
FIG. 1 is a perspective view illustrating a cloth treating apparatus.

FIG. 1 is a perspective view illustrating a cloth treating apparatus.

As shown in FIG. 1, a cloth treating apparatus 1 includes a main body 10 constituting appearance, and a control panel 11 arranged on a front surface or an upper surface of the main body 10. In this case, the control panel may include a controller which controls the operation of the cloth treating apparatus. Accordingly, a user performs cloth treating such as washing or drying by manipulating the control panel.

As shown in FIG. 1, the cloth treating apparatus could be a washing machine, a dryer, or a dryer with washing function.

Meanwhile, the cloth treating apparatus 1 may include a support 20 which supports the main body 10 against the bottom. The main body 10 is arranged at an upper part of the support 20. However, the support 20 serves to support the washing machine or the dryer but is not used for the other functions. Accordingly, an auxiliary treating apparatus, which washes or dries clothes of small quantity in addition to support of the main body 10, has been required.

Hereinafter, such an auxiliary treating apparatus will be described in detail with reference to the accompanying drawings.

Figure 2:
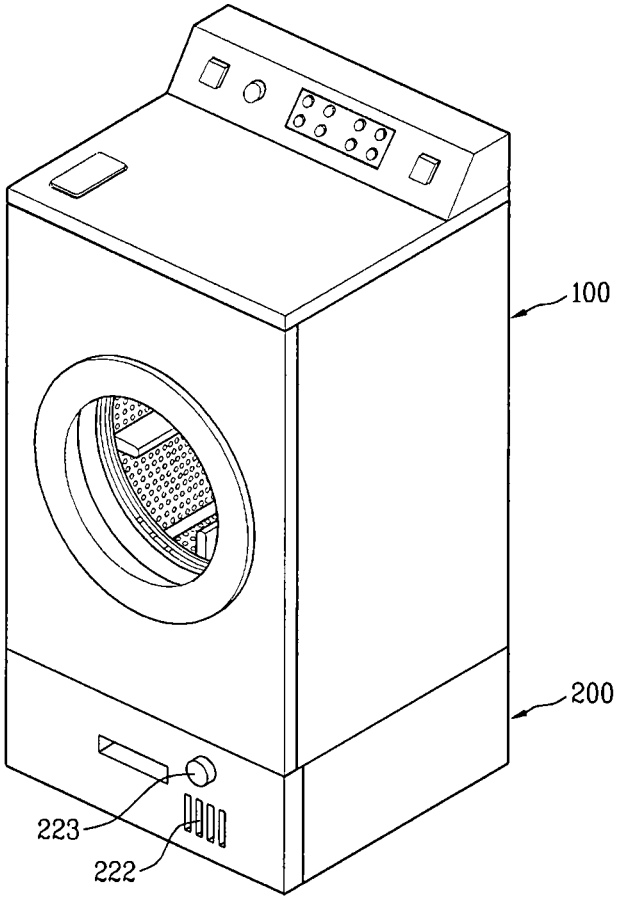
FIG. 2 is a perspective view illustrating a cloth treating apparatus comprising an auxiliary treating apparatus according to the present invention.

FIG. 2 is a perspective view illustrating a cloth treating apparatus comprising an auxiliary treating apparatus according to the preferred embodiment of the present invention.

Referring to FIG. 2, the cloth treating apparatus according to the embodiment of the present invention can include a main body 100 which washes or dries clothes, and an auxiliary treating apparatus 200 provided at one side of the main body 100.

Accordingly, in the embodiment of the present invention, the auxiliary treating apparatus 200 is provided at one side of the main body 100 which performs washing, drying or both washing and drying. For example, the auxiliary treating apparatus 200 may be provided at a lower part of the main body 100, or, although not shown, may be provided at an upper part of the main body 100. In this case, it is preferable that a controller of the main body 100, i.e., a control panel is formed on a front surface of the main body 100. Meanwhile, although not shown, the auxiliary treating apparatus 200 may be arranged at a side of the main body 100.

The auxiliary treating apparatus may constitute a cloth treating apparatus for washing or drying in combination with the main body 100. In this case, clothes are received inside the main body 100 to perform washing or drying. In other words, the main body 100 could be a washing machine, a dryer, or a washing machine with drying function. Meanwhile, the auxiliary treating apparatus 200 may be connected to the lower part or the upper part of the main body 100 by a coupling means (not shown).

In the embodiment of the present invention, it is preferable that the auxiliary treating apparatus 200 has a volume smaller than that of the main body 100. Also, it is preferable that the auxiliary treating apparatus 200 has a height lower than that of the main body 100. This is because that the auxiliary treating apparatus 200 is used to perform an auxiliary function of the main body 100 in the embodiment of the present invention.

Hereinafter, the auxiliary treating apparatus according to the preferred embodiments of the present invention will be described in detail with reference to the accompanying drawings.

Figure 3:
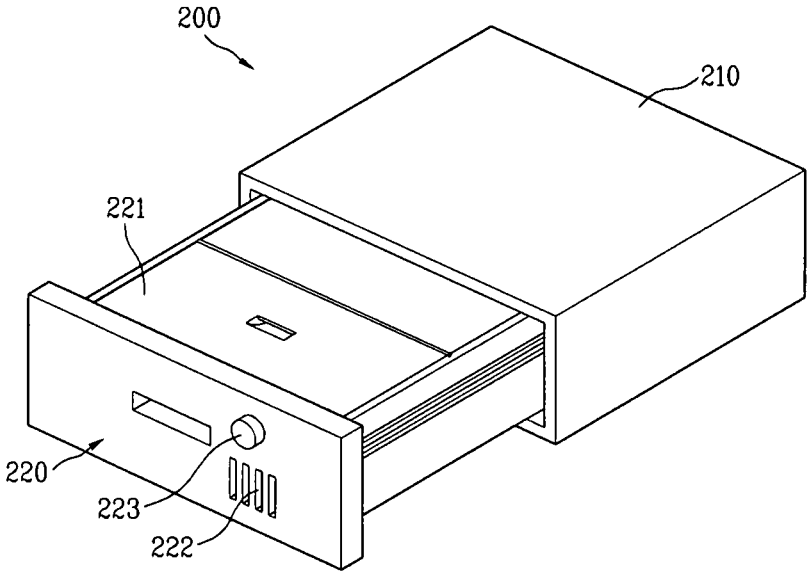
FIG. 3 is a perspective view illustrating an auxiliary treating apparatus according to the present invention.
Figure 4:
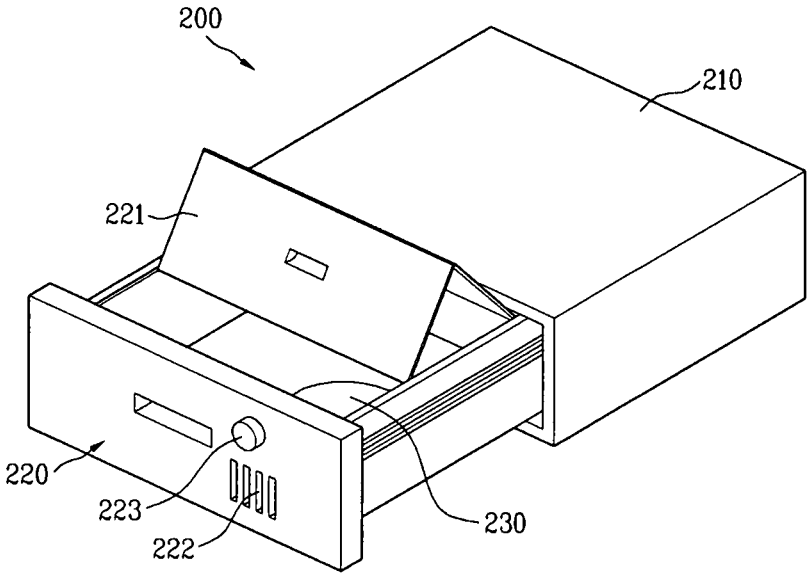
FIG. 4 is a perspective view illustrating the state that a cover of an auxiliary treating apparatus according to the present invention is opened.

FIG. 3 is a perspective view illustrating an auxiliary treating apparatus according to the present invention, and FIG. 4 is a perspective view illustrating the state that a cover of an auxiliary treating apparatus according to the present invention is opened.

Referring to FIG. 3 and FIG. 4, the auxiliary treating apparatus 200 according to the embodiment of the present invention is provided with a accommodating space for receiving objects to be dried. In this case, the accommodating since can be formed inside a drawer 220 that can be drawn from a front surface of a cabinet 210 to the front, wherein the cabinet 210 forms appearance of the auxiliary treating apparatus 200.

A cover 221, which is selectively opened and closed, may be provided at an upper part of the drawer 220. The cover 221 serves to selectively shield an opening formed at the upper part of the drawer 220. Also, when the auxiliary treating apparatus 200 performs drying, the cover 221 serves to prevent a hot air from leaking out through the opening, thereby redwing power loss.

Figure 5:
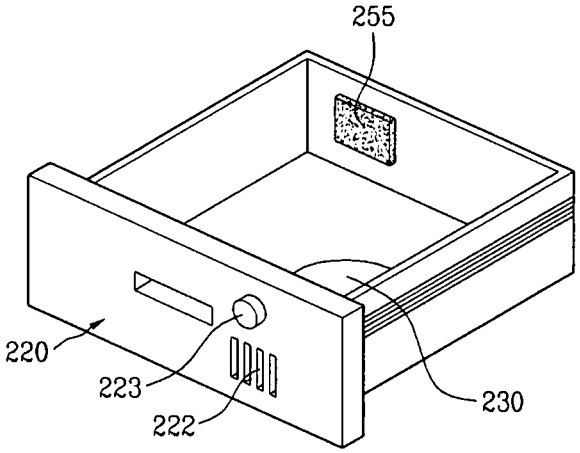
FIG. 5 is a perspective view illustrating a front surface of an auxiliary treating apparatus according to the present invention.
Figure 6:
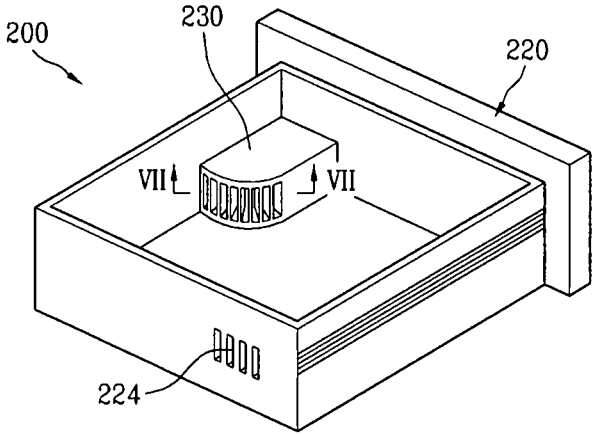
FIG. 6 is a perspective view illustrating a rear surface of an auxiliary treating apparatus according to the present invention.

FIG. 5 is a perspective view illustrating a front surface of an auxiliary treating apparatus according to the present invention, and FIG. 6 is a perspective view illustrating a rear surface of an auxiliary treating apparatus according to the present invention.

Referring to FIG. 5 and FIG. 6, an opening 222 is formed on the front surface of the drawer 220 to supply external air into the drawer 220, and an outlet 224 is formed on the rear surface of the drawer 220 to exhaust out the air inside the drawer 220. However, the location of the opening 222 and the outlet 224 is not limited to the above location, and the opening 222 and the outlet 224 may be formed anywhere the air flow into and out.

Meanwhile, the outlet 232 may be provided with a filter 255. The filter 255 serves as a deodorizing filter that prevents a smell from leaking out through the outlet 232, wherein the smell is generated when drying of objects is performed.

Furthermore, when the smell generated from the objects dried by the auxiliary treating apparatus 200 has acidity, the filter 255 can remove the smell through a neutralizing reaction with alkali material. In this case, the filter may be formed of a porous active carbon, or alkali treatment may be performed for the active carbon to remove such acidic smell.

Furthermore, the auxiliary treating apparatus according to the embodiment of the present invention may be provided with several filters having acidity or neutrality to remove other smell ingredients in addition to the filter treated with alkali. Moreover, a plurality of alkali treated adsorbents having a global shape or a cylindrical shape may be used in such a manner that they are arranged in a box type frame.

A hot air supply device 230 may be provided inside the front surface of the drawer 220 provided with the opening 222, i.e., inside the accommodating space, so as to supply a hot air into the drawer 220. Preferably, a manipulation part 223 is formed on the front surface of the drawer 220 to control the operation of the hot air supply device 230.

Preferably, the hot air supply device 230 is provided at a corner inside the drawer 220 to more efficiently use the space where the objects to be dried are received. More preferably, the hot air supply device 230 may be provided at the corner formed on the front surface of the drawer 220. This is because that the opening 222 formed at the front of the drawer 220 should be connected with the hot air supply device 230 to supply the air to the hot air supply device 230.

It is preferable that the manipulation part 223 is formed of a mechanical type to manufacture the hot air supply device 230 with a compact size and reduce the manufacturing cost. Accordingly, the manipulation part 223 could be an on/off type power switch or a time switch.

Furthermore, the manipulation part 223 may additionally manipulate a refresh function which allows the air to be supplied into the drawer 220 and to be exhausted out without manipulation of a heater provided in the hot air supply device 230. In this case, the air is supplied by driving a ventilating fan 232 only without driving of a heater 233 of the hot air supply device 230, which will be described later. In this way, the external air is supplied into the drawer 220 to refresh clothes.

Meanwhile, the manipulation part 223 may be provided in the hot air supply device 230. In this case, the manipulation part 223 may be provided on an outer surface of the hot air supply device 230, preferably an upper surface of the hot air supply device 230.

Figure 7:
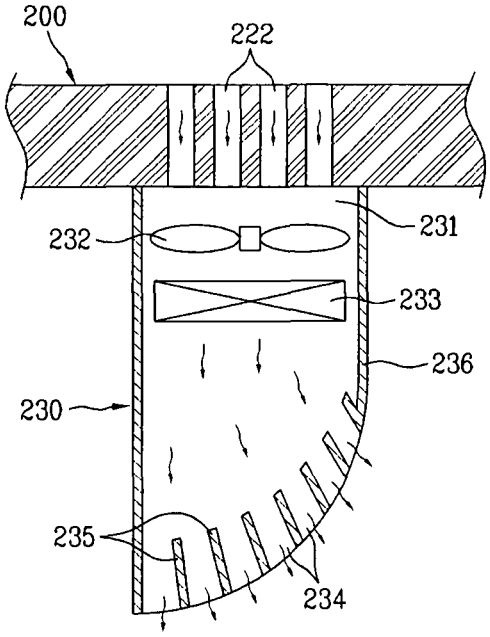
FIG. 7 is a cross-sectional view taken along line VII-VII of FIG. 6.

FIG. 7 is a cross-sectional view taken along line VII-VII of FIG. 6, illustrating a hot air supply device according to the present invention.

Referring to FIG. 7, the hot air supply device 230 includes a housing 236 provided with an inlet 231 and an outlet 234, a ventilating fan 232 ventilating the air, and a heater 233 heating the air, wherein the air flows into the inlet 231 and the outlet 234 supplies the heated air into the drawer 220.

It is preferable that the inlet 231 of the housing 236 is connected with the opening 224 of the drawer 220 to connect with the outside. In other words, the external air, which enters through the opening 224, flows into the housing 236 through the inlet 231.

The ventilating fan 232 ventilates the air flown through the inlet 231 so that the air is supplied into the drawer 220 and then exhausted to the outlet 224. Accordingly, it is preferable that the ventilating fan 232 is comprised of an intake fan which is formed at the inlet 231 and forcibly supplies the external air into the drawer 220.

Meanwhile, the heater 233 heats the air flowing through the ventilating fan 232 to supply the heated air into the drawer 220. The heater can be provided in various types. In the embodiment of the present invention, a sheath heater can be used as the heater 233. Since the sheath heater has durability robust to vibration and impact, regular heat distribution, and good insulating resistance, safety accident due to a short circuit can be prevented from occurring even though the hot air supply device 230 is formed inside the drawer 220, i.e., the space where the objects to be dried are received. Accordingly, the sheath heater is suitable for the auxiliary treating apparatus 200 according to the present invention.

Furthermore, according to another embodiment of the present invention, the heater 233 is a PTC heater, which is formed by powder molding of PTC elements. The PTC heater has a variable resistance property current value varied depending on temperature. Accordingly, as temperature increases, resistance increases, and a current flowing to the heater decreases. If the heater is normally operated, since its current value is very small, safety accident due to a leakage current is avoided even though a problem such as a short circuit occurs.

Such a PTC heater may be provided in plural numbers. If a fixed temperature heating effect of a plurality of PTC heaters is used, a temperature of the heater used during drying can be adjusted depending on the objects to be dried. In case of the objects to be dried, which are made of materials weak to heat, drying can be performed without damage of the objects. For example, a problem such as deformation in a rubber of footwear due to heat does not occur.

Meanwhile, the hot air supply device 230 according to the embodiment of the present invention may be provided with a thermostat which controls a temperature regularly. The thermostat (not shown) is made of bimetal by bonding two alloy plates having different linear expansion coefficients. In this case, a switch is opened and closed using a feature that a baking level of bimetal is varied depending on temperature change. This is to allow the power to be turned off automatically when the temperature becomes greater than a designated temperature due to the heater 233.

The heated air flowing through the ventilating fan 232 and passing through the heater 234 is exhausted into the drawer 220 through the outlet 234.

Meanwhile, it is preferable that a front end of the housing 236 where the outlet 234 is formed has an arc shape to exhaust the air passing thorough the hot air supply device 230 into the drawer 220 in a wide range. However, the front end of the housing 236 is not limited to such an arc shape, and it is to be understood that the front end of the housing 236 may have any shape which allows the air exhausted through the outlet 234 to be distributed into the drawer in a wide range.

Furthermore, it is preferable that the outlet 234 is provided with an air guide 235 which guides flow of the air to regularly distribute the air into the drawer 220. The air guide 235 is formed in such a manner that a plurality of air guides are spaced apart from one another along the shape of the outlet 234 to guide the flow of the air exhausted from the outlet 234. Accordingly, the air flowing in one direction through the ventilating fan 232 can be exhausted by being extended into the drawer 220 by the air guide 235.

Hereinafter, a drying rack that can arrange objects to be dried inside the drawer will be described in detail.

Figure 8:
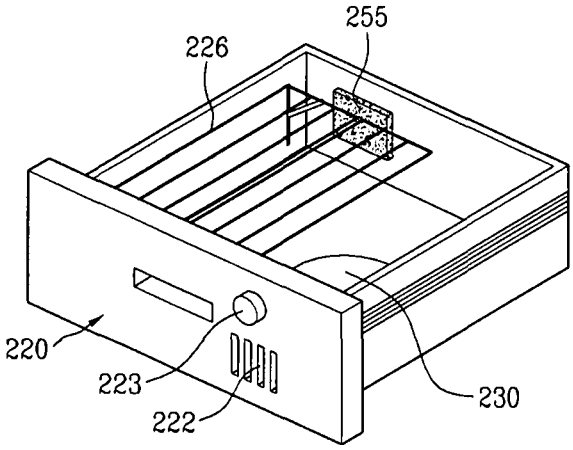
FIG. 8 is a perspective view illustrating the state that a drying rack according to the present invention is folded.
Figure 9:
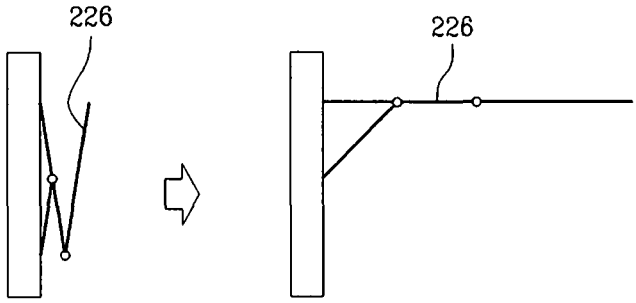
FIG. 9 is a perspective view illustrating the state that a drying rack according to the present invention is unfolded.

FIG. 8 is a perspective view illustrating the state that a drying rack is provided inside the drawer in accordance with the embodiment of the present invention, and FIG. 9 is a perspective view illustrating the state that the drying rack of FIG. 8 is unfolded.

Referring to FIG. 8 and FIG. 9, the auxiliary treating apparatus 200 according to the embodiment of the present invention can include a drying rack 226 inside the drawer 220, wherein the objects to be dried are arranged on the drying rack 226.

Preferably, the drying rack 226 is fixed to one side of the drawer 220 so that it is folded or unfolded. In other words, if the objects to be dried, of which shapes are easily varied or which are made of fine fiber, are laid and dried inside the drawer 220, their shapes are varied or their regular drying is not easy. Accordingly, such objects, of which shapes are easily varied or which are made of fine fiber, are laid on the drying rack 226 which is unfolded, as shown in FIG. 9.

Furthermore, as shown in FIG. 9, the drying rack 226 is folded so that the objects to be dried, of which sizes are big, such as shoes, are directly laid on the bottom of the drawer 220, whereby space use inside the drawer 220 is maximized.

Figure 10:
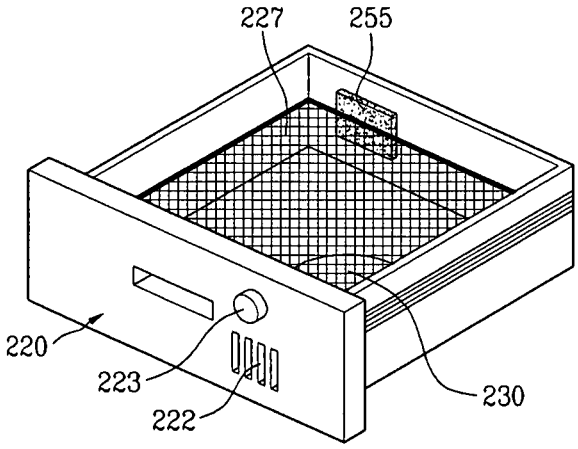
FIG. 10 is a perspective view illustrating another drying rack according to the present invention.

FIG. 10 is a perspective view illustrating another drying rack according to the embodiment of the present invention.

Referring to FIG. 10, a shelf 227 which is detachably formed to partition the space inside the drawer 220 up and down can be used as the drawing rack. The shelf 227 is preferably formed in such a manner that the partitioned parts are connected with each other. This is to allow the air supplied into the drawer 220 to be exhausted desirably.

Accordingly, it is preferable that a plurality of through holes are formed in the shelf 227. In other words, a lower part of the shelf is connected with an upper part of the shelf through the through holes so as to enable flow of the air. Also, since the water drops from the wet objects to be dried to the lower part of the shelf through the through holes, drying efficiency can be improved.

Meanwhile, the drawer 220 is preferably provided with a protrusion (not shown) so that the shelf 227 can be arranged on the protrusion. The protrusion is preferably formed along the inner circumference of the drawer 220 to partition the inner part of the drawer 220 up and down.

Hereinafter, a use method of the auxiliary treating apparatus 200 according to the present invention will be described.

First of all, the user draws the drawer 220 to arrange the objects to be dried, sirh as clothes, shoes, and hats, on the drawer 220. The drying racks 226 and 227 can be used if necessary to arrange the objects to be dried thereon. The user adjusts a timer depending on types of the objects to be dried through the manipulation part 223, so as to start drying.

If drying starts, the hot air is forcibly supplied into the drawer 220, where the objects to be dried are received, through the hot air supply device 230. In other words, the air flows into the air supply device through the ventilating fan 232, and the flown air is heated by the heater 233 and then supplied into the drawer 220.

The air discharged from the hot air supply device 230 is extended and supplied into the drawer 220 along the air guide 235.

The air flowing into the drawer 220 dries the objects to be dried, and is exhausted out through the outlet 224. At this time, a smell generated during drying is removed by the filter 255 formed at the outlet 224.

Accordingly, if the time adjusted by the user ends through repeating the above procedure, the auxiliary treating apparatus 200 finishes the operation.

It will be apparent to those skilled in the art that the present invention can be embodied in other specific forms without departing from the spirit and essential characteristics of the invention. Thus, the above embodiments are to be considered in all respects as illustrative and not restrictive. The scope of the invention should be determined by reasonable interpretation of the appended claims and all change which comes within the equivalent scope of the invention are included in the scope of the invention.

It will be apparent to those skilled in the art that the present invention can be embodied in other specific forms without departing from the spirit and essential characteristics of the invention. Thus, the above embodiments are to be considered in all respects as illustrative and not restrictive. The scope of the invention should be determined by reasonable interpretation of the appended claims and all change which comes within the equivalent scope of the invention are included in the scope of the invention.

Industrial Applicability

According to the present invention, since the auxiliary treating apparatus which enables drying of the objects of small quantity to be dried, is used without driving the cloth treating apparatus which is relatively great, it is possible to save energy along with convenient use.

It is possible to easily dry shoes, hats, and cloths, which are difficult to dry through the conventional drum type dryer.

In addition, it is possible to remove a smell of the objects to be dried, which require deodorization, such as shoes, and to refresh the objects.

Accordingly, according to the present invention, it is possible to provide the auxiliary treating apparatus of which use is convenient, by maximizing space use at low cost.

The invention claimed is:

1. A cloth treating apparatus comprising:

a main body washing or drying clothes; and an auxiliary treating apparatus including:

a cabinet provided at one side of the main body; and a drawer slidably provided in the cabinet to form an accommodating space, the drawer having a hot air supply device provided in the accommodating space, the hot air supply device including:

a housing provided at a corner side inside the drawer and having an inlet to flow an external air thereto and an outlet to exhaust the flown air;

a ventilating fan provided at a side inside the housing, to ventilate the air, which flows through the inlet, through the outlet; and a heater provided at a side inside the housing to heat the flown air, wherein the housing includes a front wall, a side wall, and a connection wall directly connecting the front wall to the side wall, the connection wall being arcuate, and the front wall, side wall and connection wall defining an inner space of the housing, and wherein the outlet is a plurality of outlets formed in the connection wall.

2. The cloth treating apparatus according to claim 1, wherein the cabinet is provided at an upper part or a lower part of the main body.

3. The cloth treating apparatus according to claim 1, wherein the outlet is provided with an air guide which guides flow of the air.

4. The cloth treating apparatus according to claim 3, wherein the air guide includes a plurality of plates spaced apart from one another along the outlet.

5. The cloth treating apparatus according to claim 1, wherein the drawer includes an opening into which the air flows, and an outlet which exhausts out the air inside the drawer.

6. The cloth treating apparatus according to claim 5, wherein the outlet is provided with a filter.

7. The cloth treating apparatus according to claim 1, wherein the auxiliary treating apparatus further comprises a cover provided at an upper part of the drawer and selectively opened and closed.

8. The cloth treating apparatus according to claim 1, wherein the auxiliary treating apparatus further comprises a drying rack provided inside the drawer to arrange clothes thereon.

9. The cloth treating apparatus according to claim 8, wherein the drying rack is fixed to one side of the drawer and selectively unfolded, or is formed of a shelf which is detachably formed to partition the space inside the drawer up and down.

10. The cloth treating apparatus according to claim 9, wherein the drying rack is provided with a plurality of through holes.

* * * * *